United States Patent [19]

Philberth et al.

[11] 4,365,224

[45] Dec. 21, 1982

[54] CORE LAMINATION FOR SHELL-TYPE CORES, PARTICULARLY FOR TRANSFORMERS

[75] Inventors: Bernhard Philberth; Karl Philberth, both of Puchheim, Fed. Rep. of Germany

[73] Assignee: Wilfried Ernst Sawatsky, North Balwyn, Australia

[21] Appl. No.: 953,100

[22] Filed: Jan. 22, 1979

[30] Foreign Application Priority Data

Oct. 25, 1977 [CH] Switzerland ..... 12939/77
Dec. 10, 1977 [DE] Fed. Rep. of Germany ..... 2755218

[51] Int. Cl.[3] ..... H01F 27/24
[52] U.S. Cl. ..... 336/212; 336/217
[58] Field of Search ..... 336/216, 217, 212, 234, 336/165, 178

[56] References Cited

U.S. PATENT DOCUMENTS

| | | | |
|---|---|---|---|
| 2,143,745 | 1/1939 | Sola | 336/165 X |
| 2,489,977 | 11/1949 | Porter | 336/218 X |
| 2,806,199 | 9/1957 | Sola | 336/165 X |
| 3,181,402 | 4/1965 | Kuck et al. | 336/217 X |
| 3,461,758 | 8/1969 | Michiulis | 336/212 X |
| 3,546,571 | 12/1970 | Fletcher et al. | 336/165 X |
| 4,149,136 | 4/1979 | Philberth et al. | 336/217 |
| 4,158,186 | 6/1979 | Philberth et al. | 336/217 |

FOREIGN PATENT DOCUMENTS

| | | | |
|---|---|---|---|
| 794016 | 9/1968 | Canada | 336/217 |
| 2650074 | 5/1978 | Fed. Rep. of Germany | 336/217 |
| 67594 | 3/1958 | France | 336/217 |

OTHER PUBLICATIONS

"Technische Angabem zum PMZ," Philberth, Feb. 1978.

*Primary Examiner*—Thomas J. Kozma

[57] ABSTRACT

The invention concerns a transformer lamination of the EI type, having a center leg, two outer legs and two yokes connecting these legs and having joints between one side of the center leg and between one side of the outer legs and the adjacent yoke for interleaving with a winding. The characteristic feature is that the width of the jointlessly connecting yoke is greater than that of the parted yoke, and that the width of the parted yoke and/or the width of the two outer legs is greater than half the center leg width.

9 Claims, 3 Drawing Figures

CORE LAMINATION FOR SHELL-TYPE CORES, PARTICULARLY FOR TRANSFORMERS

The invention relates to core laminations for shell-type cores, particularly for transformers, comprising a plurality of stacked core laminations, said core laminations having a center leg of substantially uniform width, two outer legs parallel thereto at a certain distance, and two yokes connecting the ends of said legs, at least one joint being provided between one side of the center leg and the adjacent yoke for interleaving in the winding, and where the width of the jointlessly connecting yoke of said core laminations is greater than that of the parted yoke ($c_1 > c_2$).

In addition to the so-called M type of core laminations for shell-type cores, however, there is also another very widely used type, namely the so-called EI core lamination, for instance according to U.S. Pat. No. 3,546,571. Core laminations of the EI type are distinguished in particular by very economical manufacture because they can be stamped with little or no waste at all, the I parts being obtained from the waste left after the E parts have been stamped.

It is the object of the invention to provide a new and improved design utilizing EI core laminations, so that a core composed of such laminations will be characterized by lower reluctance, reduced magnetic leakage and higher efficiency.

According to the invention this object is achieved in that the core laminations are of two-piece EI construction where the width of the jointlessly connecting yoke is greater than the width of the parted yoke, and the width of said parted yoke and/or the width of the two outer legs is greater than half the center leg width.

However, these measures not only supply an advantageous solution to the given problem but also provide core laminations of quite general application. Stacked alternately, these core laminations yield transformers of much improved magnetic and electrical characteristics; and stacked in the same direction, they can be used to advantage to make welded cores, cemented cores or clamped cores. This applies particularly to EI laminations when the width of the jointlessly connecting yoke is greater than half the center leg width, preferably when the sum of the widths of the two yokes is at least 1.3 times, maximum 1.4 times the center leg width and the outer leg width is at least 1.2 times, maximum 1.3 times half the center leg width. A 5% increase of the width of the jointlessly connecting yoke with reference to the width of the parted yoke yields fair results, a 10% increase yields good results, a 20% increase yields excellent results.

An embodiment of the invention is represented diagrammatically in the drawing, in which.

Figure 1:
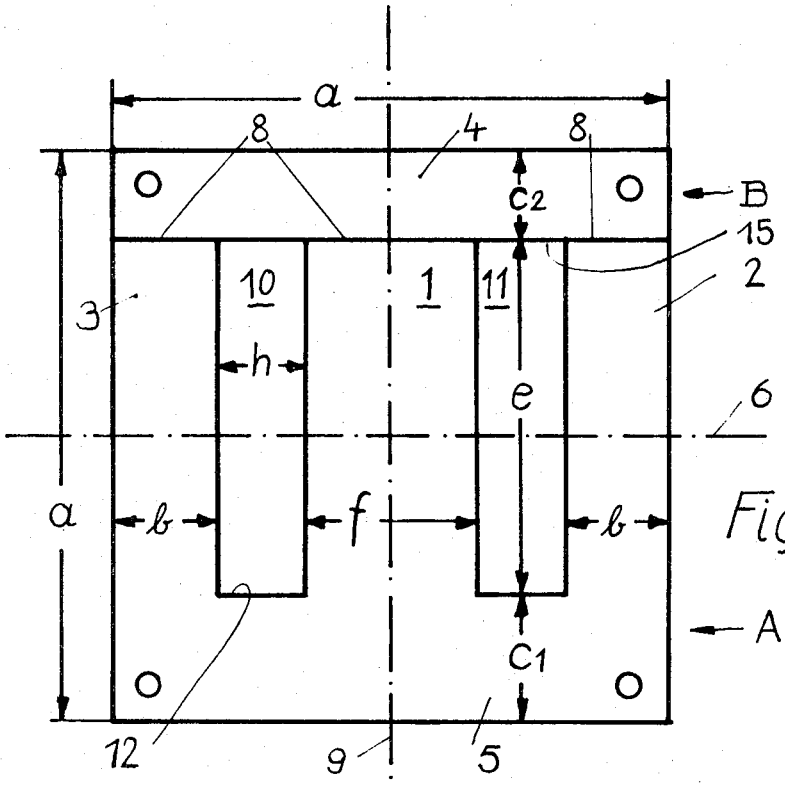
FIG. 1 is the plan view of an EI core lamination.

The embodiment according to FIG. 1 shows a so-called EI core lamination for iron cores in shell-type transformers or the like consisting of an E part A which has a yoke 5, a center leg 1 and two outer legs 2 and 3 parallel thereto at a certain distance, and of an I part B which forms the second yoke 4 of the core lamination. Hence, the yoke 4 is separated by a joint 8 both from center leg 1 and from the two outer legs 2 and 3. The core lamination according to the embodiment is square with equal edge lengths a, although it may also have unequal edge lengths. The distance between the center leg 1 and outer legs 2 and 3 respectively corresponds roughly to the width of the yoke 4 which forms the I part B. This means that the window width h is equal to or greater than the width $c_2$ of the I part B because this is the only possibility of obtaining the I parts B from the window parts stamped out of the E parts A and hence of cutting the stamping waste to a minimum. Two E parts A are stamped simultaneously, with their legs pointing toward one another, so that the two window stampings, i.e. the two I parts B, will be of the necessary length. Thus the waste amounts to no more than twice the window length e minus the length a of the I part B of the free yoke 4.

The yoke 5 of the E part A holds the legs 1, 2 and 3 together, its width $c_1$ being greater than the width $c_2$ of the free yoke 4, i.e. the I part B.

The width of the two outer legs 2 and 3 and of the two yokes 4 and 5 is greater than half the width f/2 of the center leg 1. The width b of the outer legs 2 and 3 is preferably 1.2 to 1.3 times half the width f/2 of the center leg 1 whereas the sum of the widths $c_1$ and $c_2$ of the two yokes 4 and 5 amounts to 1.3 to 1.4 times the width f of the center leg 1.

The center leg 1, the two outer legs 2 and 3 and the two yokes 4 and 5 enclose the windows 10 and 11, being of window length e calculated in the direction of the longitudinal axis 9 of the center leg 1. The windows 10 and 11 are asymmetrical to the transverse axis 6 because the width $c_1$ of the jointlessly connecting yoke 5 is greater than the width $c_2$ of the parted yoke 4, i.e. the I part B.

Figure 2:
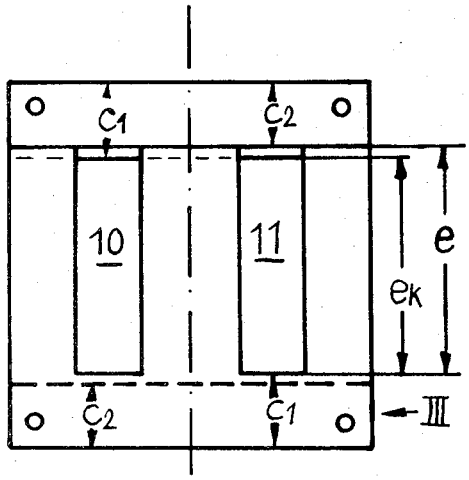
FIG. 2 is the plan view of a shell-type core consisting of alternately stacked EI core laminations.
Figure 3:
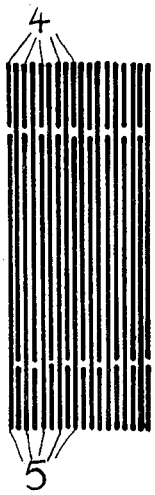
FIG. 3 shows the shell-type core according to FIG. 2, looking in the direction of arrow III in FIG. 2.

The shell-type core according to FIGS. 2 and 3 contains core laminations according to FIG. 1, said core laminations being stacked alternately. The inside edges 12 of the jointlessly connecting yoke 5 of the E parts A are in contact with the omitted winding and its supporting coil form, respectively. In contrast, the inside edges 15 of the parted yoke 4, i.e. the I parts B are spaced away from the winding and its coil form respectively, by an amount corresponding to the yoke width difference $c_1-c_2$. The inside length $e_K$ of the windows in the shell-type core is shorter, by the yoke width difference $c_1-c_2$, than the length e of the windows 10 and 11 of the individual core laminations. This form of stacking the core laminations serves to modify the poor, parted yoke cross-section in favour of the beneficial, jointless yoke cross-section, without any substantial disadvantage having to be taken into account. There is no change in the amount of material, stacking time, yoke cross-section or coil form.

In a core consisting of alternately stacked laminations of the above kind, the joints are located inside the yokes so that some of the magnetic flux can flow out of the yoke in an undivided stream before it even reaches the joints, so diminishing the influence due to said joints. This influence can be diminished still further by making the outer legs wider than half the center leg.

It is also possible to stack the EI laminations of the invention in the same direction in the core, the E parts A and I parts B then being cemented, clamped or welded together after the insertion of the winding and its supporting coil form, respectively. This procedure is particularly adopted in cases where the benefits to the manufacturing process have priority over the electrical characteristics. Here again, advantages are obtained by using the core laminations according to the invention. The magnetic leakage of a shell-type core constructed thus is very low at the end with the jointlessly connecting yoke, firstly because the latter is of larger cross-section and hence of lower reluctance and secondly because all the joints are situated at the other end in the parted yoke of the shell-type core.

The invention thus provides a core lamination of really universal application, with the result that a single type or core lamination, namely the EI core lamination according to the invention, will be suitable for practically all purposes.

I claim:

1. Core laminations for shell-type cores, particularly for transformers, comprising a plurality of said laminations alternatingly reversed, each of said core laminations being of two-piece EI construction comprising an E-part and an I-part, two of said I-parts being obtained from the window stampings of two E-parts stamped simultaneously with the legs pointing toward one another and having a center leg of substantially uniform width, and two yokes connecting the ends of said legs, said yokes being provided with inside edges facing the windows and joints being provided between one side of the center leg and between one side of the outer legs and the adjacent yoke for interleaving with a winding, and the other yoke having no joints with the center leg and the two outer legs, wherein the width ($c_1$) of the jointless connecting yoke is greater than the width ($c_2$) of the parted yoke ($c_1 > c_2$), and greater than half the center leg width ($c_1 > f/2$) and the width (b) of the two outer legs is greater than half the center leg width (f/2) ($b > f/2$) and wherein in said plurality of said laminations alternatingly reversed the inside edges of said parted yoke are spaced away from said winding in contrast to the inside edges of said jointlessly connecting yoke with the inside edges of said parted yoke spaced from the inside edges of said jointlessly connecting yoke and the jointlessly connecting yoke inner edges nearer the winding than the inside edges of said parted yoke and said joints are located inside the yokes of said shell-type core.

2. Core laminations for shell-type cores as defined in claim 1 wherein the width ($c_1$) of the jointlessly connecting yoke is at least 5% greater than the width ($c_2$) of the parted yoke.

3. Core laminations for shell-type cores as defined in claim 1 wherein the sum of the widths ($c_1+c_2$) of said two yokes is at least 1.3 times and maximum 1.4 times the center leg width (f).

4. Core laminations for shell-type cores as defined in claim 1 wherein the outer legs width (b) is at least 1.2 times and maximum 1.3 times half the center leg width (f/2).

5. Core laminations for shell-type cores as defined in claim 1 wherein the width ($c_1$) of the jointlessly connecting yoke is at least 5% greater than the width ($c_2$) of the parted yoke and the outer legs width (b) is at least 1.2 times and maximum 1.3 times half the center leg width (f/2).

6. Core laminations for shell-type cores as defined in claim 1 wherein in said plurality of said laminations alternatingly reversed, the inside length ($e_K$) of the windows is shorter, by the difference between the widths of said two yokes ($c_1-c_2$), than the length (e) of the windows of the individual core laminations.

7. Core laminations for shell-type cores as defined in claim 1 wherein in said plurality of said laminations alternatingly reversed the inside length ($e_K$) of the windows is shorter, by the difference between the widths of said two yokes ($c_1-c_2$), than the length (e) of the windows of the individual core laminations and the outer legs width (b) is at least 1.2 times and maximum 1.3 times half the center leg width (f/2).

8. Core laminations for shell-type cores as defined in claim 1 wherein the parted yoke is at least half the center leg width (f/2).

9. Core laminations for shell-type cores as defined in claim 1 wherein the width ($c_2$) of the parted yoke is at least half the center leg width (f/2) and the outer legs width (b) is at least 1.2 times and maximum 1.3 times half the center leg width (f/2).

* * * * *